US007944271B2

(12) United States Patent
Illegems

(10) Patent No.: US 7,944,271 B2
(45) Date of Patent: May 17, 2011

(54) TEMPERATURE AND SUPPLY INDEPENDENT CMOS CURRENT SOURCE

(75) Inventor: Paul F. Illegems, Tucson, AZ (US)

(73) Assignee: Standard Microsystems Corporation, Hauppauge, NY (US)

( * ) Notice: Subject to any disclaimer, the term of this patent is extended or adjusted under 35 U.S.C. 154(b) by 32 days.

(21) Appl. No.: 12/368,378

(22) Filed: Feb. 10, 2009

(65) Prior Publication Data

US 2010/0201406 A1 Aug. 12, 2010

(51) Int. Cl.
*G05F 1/10* (2006.01)

(52) U.S. Cl. ..... 327/513; 327/539

(58) Field of Classification Search ..... 327/513, 327/539; 323/313
See application file for complete search history.

(56) References Cited

U.S. PATENT DOCUMENTS

| | | | | |
|---|---|---|---|---|
| 5,180,967 | A * | 1/1993 | Yamazaki | 323/315 |
| 5,543,746 | A * | 8/1996 | Kuo | 327/543 |
| 5,818,294 | A * | 10/1998 | Ashmore, Jr. | 327/543 |
| 5,982,227 | A * | 11/1999 | Kim et al. | 327/543 |
| 6,060,918 | A * | 5/2000 | Tsuchida et al. | 327/143 |
| 6,133,718 | A * | 10/2000 | Calafato et al. | 323/312 |
| 6,448,844 | B1 * | 9/2002 | Cho | 327/538 |
| 6,831,505 | B2 * | 12/2004 | Ozoe | 327/541 |
| 6,914,831 | B2 * | 7/2005 | Di Iorio | 365/189.09 |
| 6,958,597 | B1 * | 10/2005 | Lin et al. | 323/313 |
| 7,057,448 | B2 * | 6/2006 | Tanigawa et al. | 327/543 |
| 7,110,729 | B1 * | 9/2006 | Dash | 455/127.1 |
| 7,157,894 | B2 * | 1/2007 | Fulton et al. | 323/315 |
| 7,161,440 | B2 * | 1/2007 | Meltzer | 331/76 |
| 7,227,401 | B2 * | 6/2007 | Zhang et al. | 327/513 |
| 7,411,442 | B2 * | 8/2008 | Yokoo | 327/538 |
| 7,446,683 | B2 | 11/2008 | Perner | |
| 7,495,507 | B2 * | 2/2009 | Choi | 327/543 |
| 7,675,353 | B1 * | 3/2010 | Mack | 327/539 |
| 2004/0046538 | A1 * | 3/2004 | Sivero et al. | 323/315 |
| 2008/0074173 | A1 * | 3/2008 | Tu | 327/543 |
| 2008/0218253 | A1 | 9/2008 | Pietri et al. | |
| 2009/0128231 | A1 * | 5/2009 | Choi | 327/543 |

* cited by examiner

*Primary Examiner* — Thomas J Hiltunen
(74) *Attorney, Agent, or Firm* — Meyertons Hood Kivlin Kowert & Goetzel, P.C.; Jeffrey C. Hood

(57) ABSTRACT

An improved current source may provide an improvement over a typical $\Delta V_{gs}$-type current source. The improved current source may comprise two branches. A first branch may be configured to generate a PTC (proportional to absolute temperature) current based on a $\Delta V_{gs}$ developed across a resistor. A second branch may be configured to generate an NTC (inversely proportional to absolute temperature) current. The PTC current and NTC current may be combined to obtain a third current having a magnitude that is the sum of the respective magnitudes of the PTC current and the NTC current, and a temperature coefficient that is a combination of the respective temperature coefficients of the PTC current and NTC current. The current source may be configured to generate the NTC current and PTC current to be substantially insensitive to variations in the supply voltage.

27 Claims, 4 Drawing Sheets

TEMPERATURE AND SUPPLY INDEPENDENT CMOS CURRENT SOURCE

BACKGROUND OF THE INVENTION

1. Field of the Invention

This invention relates generally to the field of semiconductor circuit design, and more particularly to the design of improved current source circuits.

2. Description of the Related Art

A current source is an essential circuit component of many analog integrated circuits. To put simply, a current source is a circuit that delivers or absorbs current. In theory, an ideal (independent) current source should deliver a substantially constant current, unaffected by surrounding environmental factors and/or any other variables in the circuit. For example, current sources should preferably not be influenced by variations of the load, supply voltage, or changes in temperature, to ensure stable and predictable operation of the system and/or circuit relying on the current sources. Circuit components that may be sensitive to temperature variations, such as transistors, should especially be supplied with temperature-independent or controllably temperature-dependent currents for reliably predictable operation.

Since most electrical components have a temperature coefficient, current sources comprising electrical components are typically affected by temperature variations. When an electrical component, e.g. a resistor has a Positive Temperature Coefficient (PTC), that resistor experiences an increase in electrical resistance as its temperature increases. The higher the coefficient, the greater the increase in electrical resistance for a given increase in temperature. In contrast, when a resistor has a negative temperature coefficient (NTC), its conductivity rises with increasing temperature, typically within a defined temperature range.

Taking into account the temperature coefficients and overall electrical characteristics of the various components from which a current source may be formed, current sources can be designed to output currents that have a positive temperature coefficient (PTC) or a negative temperature coefficient (NTC). In general, depending on the given circuit configuration and/or topology, a current may be a PTC current or an NTC current, among others. A PTC current will increase as temperature increases, and decrease as temperature decreases, while an NTC current will decrease as temperature increases, and increase as temperature decreases.

In analog integrated circuits, current sources are often used in place of resistors to generate a current without introducing attenuation in the signal path where the current source is coupled. For example, in CMOS circuits, the drain of a field effect transistor (MOSFET) can behave as a current source when properly connected to an external source of energy (such as a supply voltage) due to the intrinsically high output impedance of the MOSFET when used in a current source configuration. Although such current sources are ideally expected to behave in a stable manner, their operation can be noticeably affected by variations in environmental factors such as temperature and supply voltage.

Many other problems and disadvantages of the prior art will become apparent to one skilled in the art after comparing such prior art with the present invention as described herein.

SUMMARY OF THE INVENTION

In one set of embodiments, a small and accurate integrated current source may be designed using a CMOS process. In addition to being accurate, the output current produced by the current source may have a controllable temperature coefficient (TC) and may remain unaffected by variations the supply voltage used for powering the current source. Various embodiments of the current circuit may be based on a $\Delta V_{gs}$-type current source circuit. In one set of embodiments, one component may be added to a $\Delta V_{gs}$-type current source to enable the creation of a wide range of temperature coefficients for the output current, (which may be affected by variations in the supply voltage), while at the same time eliminating the need for a start-up circuit. In another set of embodiments, a new positive feedback loop may be introduced, which may also enable the creation of an output current having a temperature coefficient that may be of any one value from a range of temperature coefficient values, where the output current is almost independent of the supply voltage.

In one set of embodiments, a current source may comprise two branches. A first branch may be configured to generate a proportional to absolute temperature (PTAT) current having a magnitude determined by $\Delta V_{gs}/R$, where R is the value of a resistance coupled to one end of the channel of a first transistor, and $\Delta V_{gs}$ is the difference between the gate-source voltage ($V_{gs}$) of a second transistor and the $V_{gs}$ of the first transistor. The second branch may be configured to generate a negative temperature coefficient (NTC) current, and may be further configured to combine the NTC current with the PTC current to obtain a combination current having a temperature coefficient (TC) that is a combination of a TC of the PTC current and a TC of the NTC current. The currents may be generated in such a manner that the PTC current, the NTC current, and the combination current remain substantially unaffected by variations in the supply voltage used for powering the current source.

The current source may also include a third transistor configured to mirror the combination current to obtain a first mirror current having the TC of the combination current, and may be further configured to provide the first mirror current to a respective load. The current source may further be configured to include a fourth transistor configured to mirror the PTC current to obtain a second mirror current having the TC of the PTC current, and may be further configured to provide the second mirror current to a respective load. Generation of the NTC current may be accomplished by operating at least one transistor in the triode region (or linear region), with the NTC current conducted by that transistor, and either directly combining the thereby generated NTC current with the PTC current, or mirroring the NTC current to obtain a mirror NTC current, and combining the mirror NTC current with the PTC current.

Other aspects of the present invention will become apparent with reference to the drawings and detailed description of the drawings that follow.

BRIEF DESCRIPTION OF THE DRAWINGS

The foregoing, as well as other objects, features, and advantages of this invention may be more completely understood by reference to the following detailed description when read together with the accompanying drawings in which.

Figure 1:
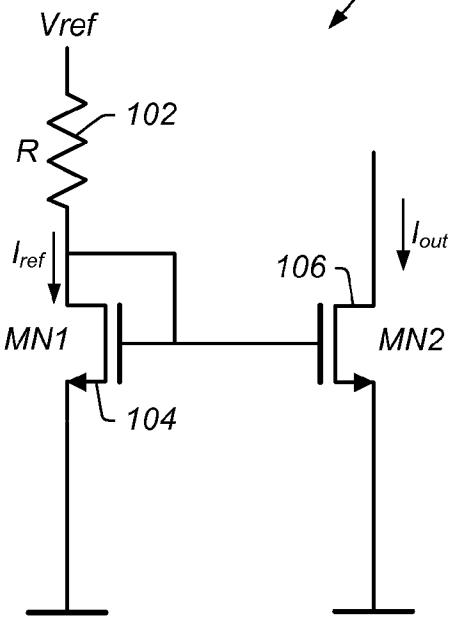
FIG. 1 (Prior Art)
FIG. 1 shows the diagram of a current source circuit configured with a resistor and current mirror, according to prior art.

While the invention is susceptible to various modifications and alternative forms, specific embodiments thereof are shown by way of example in the drawings and will herein be described in detail. It should be understood, however, that the drawings and detailed description thereto are not intended to limit the invention to the particular form disclosed, but on the contrary, the intention is to cover all modifications, equivalents, and alternatives falling within the spirit and scope of the present invention as defined by the appended claims. Note, the headings are for organizational purposes only and are not meant to be used to limit or interpret the description or claims. Furthermore, note that the word "may" is used throughout this application in a permissive sense (i.e., having the potential to, being able to), not a mandatory sense (i.e., must)." The term "include", and derivations thereof, mean "including, but not limited to". The term "connected" means "directly or indirectly connected", and the term "coupled" means "directly or indirectly connected".

DETAILED DESCRIPTION OF THE PREFERRED EMBODIMENTS

As used herein, the term "nominal value" or "nominal magnitude" is used to denote an expected, stable value/magnitude. For example, the nominal magnitude of a first current is used to denote the stable magnitude the first current is expected to reach. In this sense, the term "nominal" refers to a specified theoretical magnitude from which an actual magnitude may deviate ever so slightly. In order to simplify references to certain current values or current magnitudes detailed herein, "final value" and "final magnitude" are used to refer to the final, actual stable value/magnitude reached by the current generated by a given current source. For example, when a current source is said to generate a current having a nominal magnitude of 2.5 μA, it means that the current source is expected to generate a current that has a magnitude of 2.5 μA.

Of course, the actual final magnitude of the generated current may deviate ever so slightly from this value, and the terms "final value" and "final magnitude" are used to differentiate the actual (physical) stable value/magnitude of the current from the ideal, expected stable value/magnitude. Therefore, from a theoretical perspective, under ideal conditions a "nominal magnitude" and a "final magnitude" could refer to the exact same value, while under non-ideal conditions the "nominal value/magnitude" may be different from the "final value/magnitude".

The terms "current source" and "current generating circuit" are used interchangeably to refer to a circuit configured to generate and provide a stable current to a given circuit/system/logic block/load, etc. The expression "PTC current" (where PTC stands for Positive Temperature Coefficient) is used to reference a current having a positive temperature coefficient (TC), and the expression "NTC current" (where NTC stands for Negative Temperature Coefficient) is used to reference a current having a negative temperature coefficient (TC).

Various embodiments of circuits presented herein comprise a resistor or resistors. Those skilled in the art will appreciate that resistors may be obtained in a variety of different ways, and that the resistors disclosed herein are meant to represent circuit elements whose electrical characteristics would match the electrical characteristics of resistors as configured in the disclosed embodiments. In other words, there may be embodiments where one or more transistor devices are configured to behave in a manner commensurate with the behavior of a resistor or resistors, and the resistors disclosed herein are meant to embody all the components and/or circuit elements that may be thus configured as resistors.

Finally, references are made herein to "channels" of transistors. While the structure of a (Metal-Oxide Semiconductor Field Effect Transistors) MOSFET comprises an identifiable channel that is well known to those skilled in the art, bipolar devices (also referred to as bipolar junction devices or bipolar junction transistors—BJT) may oftentimes be swapped with MOSFET devices in certain circuit configurations to obtain similar or identical operating characteristics in those circuits. While the structure of a bipolar device might not comprise an identifiable "channel" exactly like a MOSFET (or FET) device, for the sake of simplicity, a conductive or operational path established between the collector and emitter of a bipolar device (or BJT) is also referenced herein as the "channel" of that device. In other words, when referencing the "channel" of a given transistor, the word "channel" may equally refer to the operational (or conductive) path established between the drain and the source of the transistor device if the device is a MOSFET (FET), or between the collector and the emitter of the transistor device if the device is a bipolar device (e.g. BJT).

FIG. 1 shows the diagram of a current source circuit (CSC) 100 configured with a resistor and current mirror. A reference (bias) current $I_{ref}$ set by resistor 102 constantly flows through transistor 104. An output current $I_{out}$ based on the reference current is mirrored at the drain of transistor 106, which may be matched to transistor 104 to obtain an output current $I_{out}$ having an equal magnitude to reference current $I_{ref}$. Voltage reference Vref is designed to be sufficient to provide a reference gate to source voltage ($V_{gs}$) at the gate of transistor 104, and to maintain reference current $I_{ref}$ through the drain of transistor 104. In addition, the relative sizes of NMOS devices 104 and 106 with respect to each other may be changed to obtain a magnitude of output current $I_{out}$ that is either the same, a multiple, or a fraction of the magnitude of reference current $I_{ref}$. Thus, with similar or identical transistor sizes and a single voltage Vref, the resultant current in both right and left branches may be identical. However, variations in Vref, as well as variations in transistor parameters such as threshold voltage and β can produce uncontrolled and unpredictable variations in the resultant output current flowing in the drain of transistor 106. Certain applications may not be able to use a current mirror such as the current mirror shown in FIG. 1, due to the wide variations in output current. Overall, in CSC 100 the generated current is proportional to Vref-Vgs_MN1 (where Vgs_MN1 is the gate-source voltage of transistor 104), resistor 102 needs to have large values for small currents, and there is no control over the temperature coefficient (TC) of output current $I_{out}$.

Figure 2:
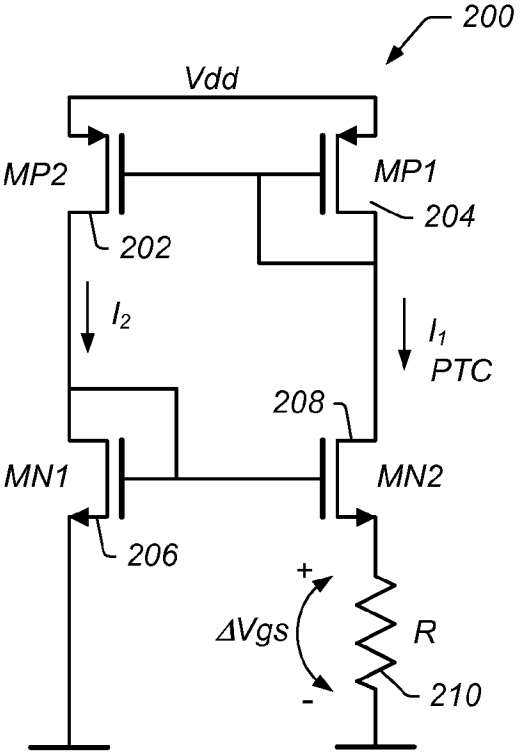
FIG. 2 (Prior Art)
FIG. 2 shows the diagram of a current source circuit configured with a $\Delta V_{gs}$ across a resistor, according to prior art.

FIG. 2 shows the diagram of a CSC 200, which provides a current developed as a result of a $\Delta V_{gs}$ across resistor 210. CSC 200 includes a current mirror comprising PMOS devices 202 and 204, coupled to NMOS devices 206 and 208, with resistor 210 coupled between the source terminal of NMOS device 208 and reference ground. If PMOS devices 202 and 204 are of the same size (i.e. have the same channel-width to channel-length ratio, i.e. the same W/L), the magnitude of the current flowing through PMOS device 202 and PMOS device 204 will be the same, with a magnitude of $I_1$. NMOS device 208 is designed to have considerably larger W/L than NMOS device 206, to ensure that a difference in gate-to-source voltage ($\Delta V_{gs}$) develops across resistor 210, resulting in a current flowing in both branches of CSC 200. Accordingly, $I_1$ will be a PTC current having a magnitude that is determined by $\Delta V_{gs}$ (between the respective $V_{gs}$ voltages of NMOS devices 206 and 208) divided by a value of resistor 210. Diode-connected NMOS device 206 conducts current $I_2$ provided via PMOS device 202, and PMOS device 208 conducts current $I_1$ provided via PMOS device 204. As mentioned above, if PMOS devices 202 and 204 are of identical sizes, the nominal magnitude of $I_1$ will be the same as the nominal magnitude of $I_2$. Similarly, a load coupled to the current source (via a third PMOS device or third NMOS device—not shown—coupled to PMOS device 204 or NMOS device 208, respectively, to mirror current $I_1$ to the load) may conduct a current having the same magnitude as the magnitude of current $I_1$, if the third transistor device is matched in size to its counterpart (as described above). As shown, CSC 200 features only PTC currents, with no currents having a zero TC. In addition, CSC 200 typically requires a start-up circuit to initiate current flow in CSC 200.

Figure 3:
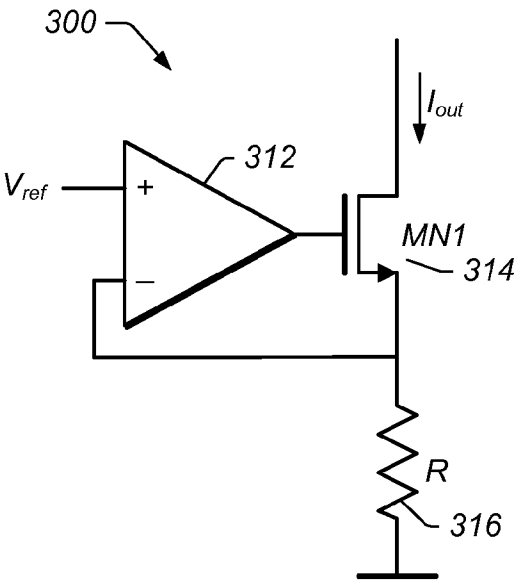
FIG. 3 (Prior Art)
FIG. 3 shows the diagram of a current source circuit configured with a $V_{ref}$ across a resistor, according to prior art.

FIG. 3 shows another common current generator circuit, CSC 300, which uses a feedback amplifier 312 for developing a reference voltage $V_{ref}$ across resistor 316. A reference voltage source is used to provide reference voltage $V_{ref}$ to the non-inverting input of amplifier 312 outside the feedback loop, to establish a desired output current through load resistor 316. The output current at the drain of NMOS device 314 corresponds to the current passing through resistor 316. Feedback amplifier 312 continually adjusts the $V_{gs}$ of NMOS transistor 314 to minimize the effects of any gate-to-drain voltage variations in NMOS device 314, thereby maintaining a desired output current $I_{out}$ in load resistor 316. Control of current $I_{out}$ depends directly on the absolute value of resistor 316 and the value/magnitude of reference voltage $V_{ref}$. While the value of $V_{ref}$ may be precisely controlled through various well-known means (e.g. with a digital-to-analog voltage converter), the magnitude of resistor 316 may not be known or well controlled and can produce uncontrolled and unpredictable variations in the resultant output current. In addition, $I_{out}$ will be proportional to $V_{ref}$, and the temperature coefficient of $I_{out}$ cannot be controlled.

Figure 4:
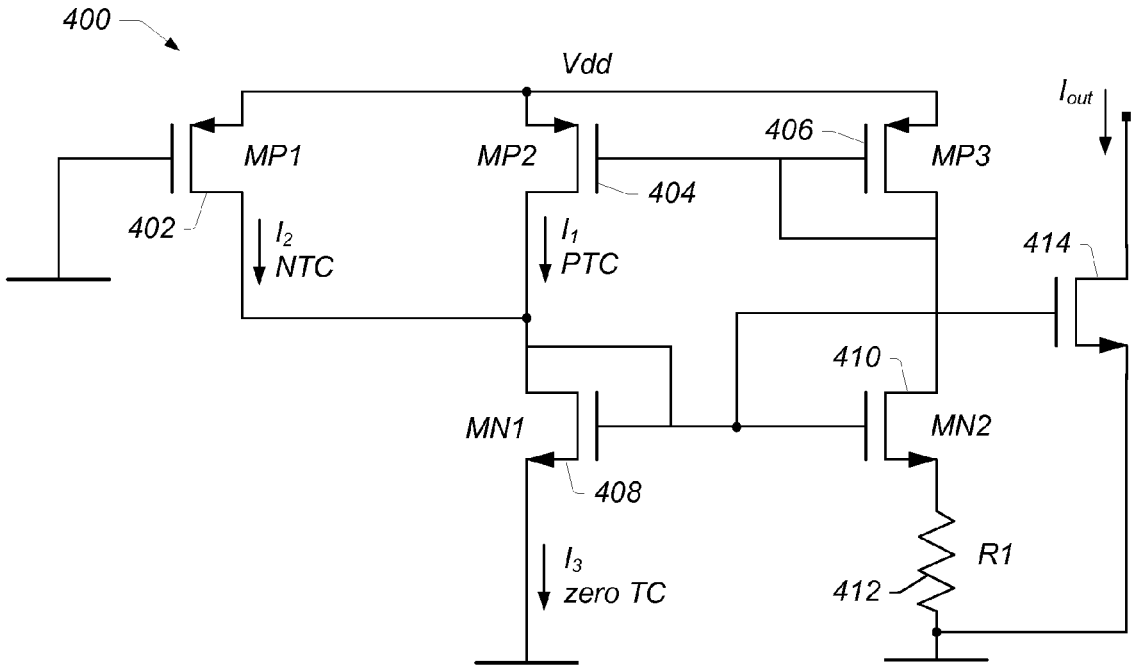
FIG. 4 shows the diagram of one embodiment of a current source circuit configured according to principles of the present invention.

One proposed embodiment for an improved current source is CSC 400 shown in FIG. 4. The proposed embodiment may be $\Delta V_{gs}$ type current source, such as the one shown in FIG. 2, for example, enhanced with a negative temperature coefficient ("NTC") branch. In other words, a branch conducting an NTC current (a current having a negative temperature coefficient) may be added to the circuit of FIG. 2 as shown in FIG. 4. Thus, in FIG. 4, PMOS device 404 corresponds to PMOS device 202 from FIG. 2, PMOS device 406 corresponds to PMOS device 204, NMOS device 408 corresponds to NMOS device 206, NMOS device 410 corresponds to NMOS device 208, and resistor 412 corresponds to resistor 210. Current $I_2$ may be obtained by coupling the gate terminal of PMOS device 402 to reference ground, while coupling its drain terminal to the drain terminal of NMOS device 406. Adding the two currents $I_1$ and $I_2$ may result in a zero TC current $I_3$. More generally, the TC of current $I_3$ may be controllable to reside at any value in the range between the available positive and negative TCs. More specifically, CSC 400 of FIG. 4 combines the $\Delta V_{gs}$-based current source with a transistor (PMOS) device 402 operating in the triode region.

PMOS device 402 may constantly conduct current $I_2$, thereby eliminating the need for a start-up circuit, which is typically required for CSC 200 shown in FIG. 2. With proper dimensioning of the transistor devices, that is, by making the channel-width to channel-length (W/L) ratio of NMOS device 410 substantially greater than the W/L of NMOS device 408 (as also described above with reference to FIG. 2), a PTC current $I_1$ may be obtained. As also mentioned above, PMOS device 402 may be operated in the triode region, with its drain current $I_2$ having a negative TC. Adding $I_1$ and $I_2$ in the right proportion may therefore result in a zero-TC current $I_3$. Since in CSC 400 the respective magnitudes of the currents $I_1$ and $I_2$ depend on Vdd, variations in Vdd may still result in a change in current $I_3$.

An output current $I_{out}$ based on $I_3$ may be obtained by mirroring current $I_3$ to a load. For example, the gate of an NMOS device 414 may be coupled to the gate of NMOS device 408 as shown, with the source of NMOS device coupled reference ground. The zero-TC current $I_3$ may thereby be mirrored by NMOS device 408 to NMOS device 414, resulting in a zero-TC output current $I_{out}$ at the drain of NMOS device 414. Again, depending on how NMOS device 414 is sized with respect to NMOS device 408, the magnitude of output current $I_{out}$ may be controlled (to be a multiple or fraction of the magnitude of $I_3$). It should also be noted, that a different output current may be obtained from current $I_1$, by coupling an additional PMOS device (not shown) to PMOS device 406 in a similar manner (gate of additional PMOS device coupled to gate of PMOS device 406, source of additional PMOS device coupled to Vdd), whereby PMOS device 406 would mirror current $I_1$ to the additional PMOS device, the output current obtained at the drain of the additional PMOS device. Thus, CSC 400 may be used to provide a stable PTC current as well as a stable zero-TC current, to be used as required by system and/or circuit considerations. For example, in one portion of a circuit a PTC current may be preferable, while another portion of the same circuit may be preferably provided with a zero-TC current. CSC 400 is capable of providing both types of currents.

Figure 5:
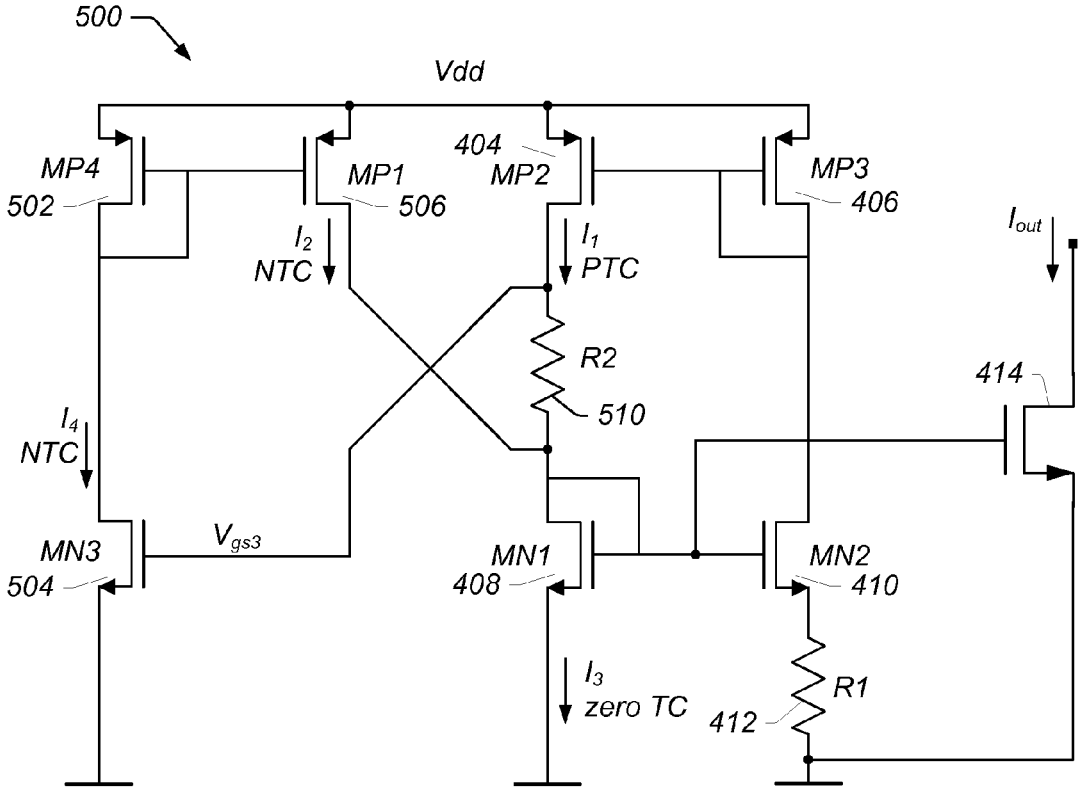
FIG. 5 shows the diagram of another embodiment of a current source circuit configured according to principles of the present invention.

FIG. 5 shows another proposed embodiment for an improved current source, CSC 500, which may be a variation of CSC 400 shown in FIG. 4 and in which currents $I_1$ and $I_2$ may be substantially insensitive to variations in Vdd. In CSC 500, NMOS device 504 may be operated in the triode region, its drain conducting a current $I_4$ having a negative TC. The drain current $I_4$ of NMOS device 504 may be mirrored by PMOS device 502 to PMOS device 506, and injected into the drain of NMOS device 408, having a similar effect as in the circuit of FIG. 4, combining (adding) currents $I_1$ and $I_2$ to obtain current $I_3$. Again, the resulting current $I_3$ may have no first-order TC (i.e. it may have a zero first-order TC, or it may have a controlled TC). The gate voltage $V_{gs3}$ of NMOS transistor 504 may be tuned by resistor 510 to obtain the desired TC of $I_2$.

Again, in a manner similar to that disclosed for CSC 400, an output current $I_{out}$ based on $I_3$ may be obtained by mirroring current $I_3$ to a load. Again, the gate of NMOS device 414 may be coupled to the gate of NMOS device 408, with the source of NMOS device 414 coupled reference ground. The zero-TC current $I_3$ may be mirrored by NMOS device 408 to NMOS device 414, resulting in a zero-TC output current $I_{out}$ at the drain of NMOS device 414. The magnitude of output current $I_{out}$ may again be controlled by the relative size of NMOS device 414 with respect to the size of NMOS device 408. A different output current may again be obtained from current $I_1$, by coupling the gate of an additional PMOS device (not shown) to the gate of PMOS device 406, and coupling the source of the additional PMOS device to Vdd, to have PMOS device 406 mirror current $I_1$ to the additional PMOS device, the output current appearing at the drain of the additional PMOS device. An NTC output current may similarly be obtained by mirroring $I_4$ from either PMOS device 502 to an additional PMOS device (not shown), or from NMOS device 504 to an additional NMOS device (not shown). Thus, CSC 500 may also be used to provide a stable PTC current and/or a stable NTC current as well as a stable zero-TC current, to be used as required by system and/or circuit considerations. Since CSC 500 does not feature a device that would by default always conduct current, CSC 500 may also require a start-up circuit to effect initial current flow in the circuit.

Figure 6:
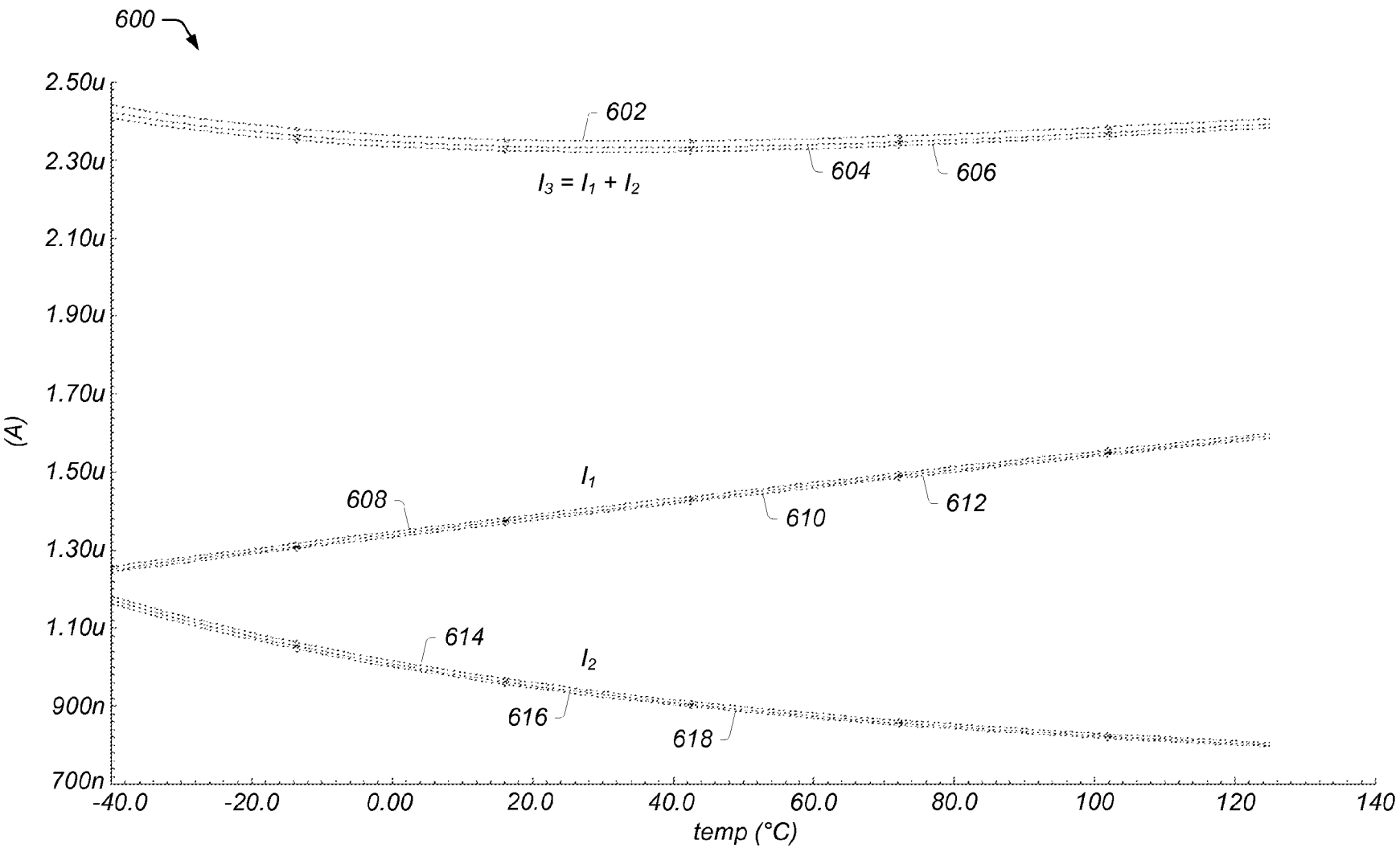
FIG. 6 shows a waveform diagram illustrating simulation results for one embodiment of the current source circuit of FIG. 5.

FIG. 6 shows a waveform diagram 600 illustrating simulation results for one embodiment of CSC 500 from FIG. 5. The currents are shown as a function of temperature for three different values/magnitudes of Vdd. A set of three curves is shown for each current, each set comprising a top, center, and bottom curve, respectively. For example, $I_1$ is illustrated by (top) curve 608 for a first value of Vdd, by (center) curve 610 for a second value of Vdd, and (bottom) curve 612 for a third value of Vdd. Similarly, $I_2$ is illustrated by (top) curve 614 for the first value of Vdd, by (center) curve 616 for the second value of Vdd, and (bottom) curve 618 for the third value of Vdd. Finally, output current $I_3$ is illustrated by (top) curve 602 for the first value of Vdd, by (center) curve 604 for the second value of Vdd, and (bottom) curve 606 for the third value of Vdd. In the simulation shown, the first value of Vdd was specified to be 3V, the second value of Vdd was specified to be 3.3V, and the third value of Vdd was specified to be 3.6V. As can be observed in waveform diagram 600, the influence of the variation in Vdd on currents $I_1$ and $I_2$, and hence on $I_3$ is minimal.

Figure 7:
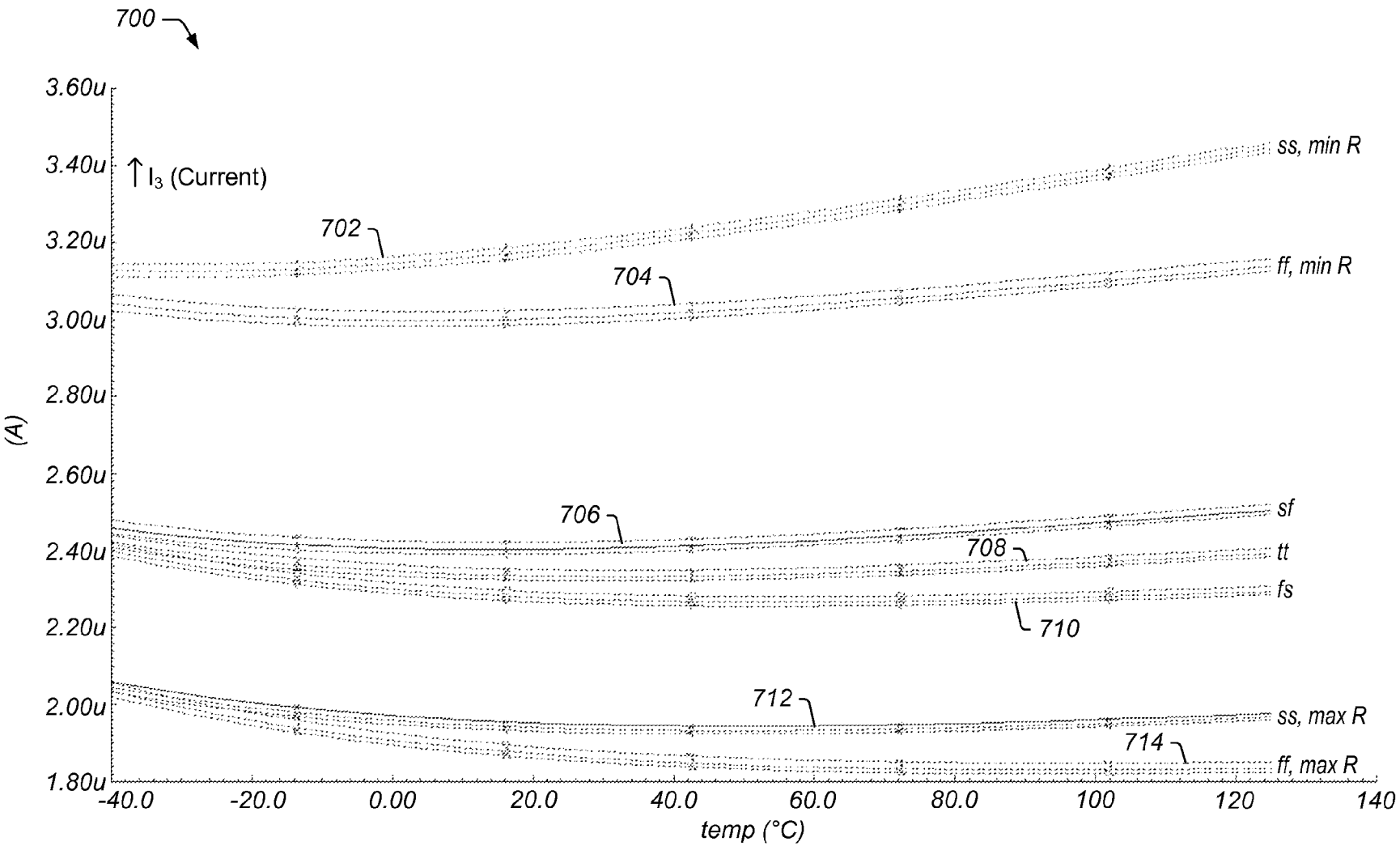
FIG. 7 shows a waveform diagram illustrating the effect of process variation on current $I_3$, for one embodiment of the current source circuit of FIG. 5.

It should be noted that variations in the integrated circuit (IC) production process may cause the three currents to change from their nominal values/magnitudes. FIG. 7 shows a waveform diagram illustrating the effects of process variation on current $I_3$, for one embodiment of CSC 500 from FIG. 5. The resulting current $I_3$ may be dependent mainly on the value of the sheet resistance, affecting both resistors 412 and 510 in CSC 500 of FIG. 5. However, as can also be observed from waveform diagram 700, the influence of the variation in Vdd on the magnitude of the currents remains minimal. In waveform diagram 700, current $I_3$ is shown as a function of temperature for three different values/magnitudes of Vdd for each of a variety of different production process corners. A set of three curves is shown for $I_3$ for each process corner, each set of curves comprising a top, center, and bottom curve that respectively represent $I_3$ for different Vdd values for the same process corner/parameters. In diagram 700, the letter combinations, e.g. "ss", correspond to one of three process corners: slow, fast and typical, with the first letter representative of the NMOS devices and the second letter representative of the PMOS devices. For example, "ss" indicates that the fabrication process yielded NMOS and PMOS devices that may be characterized as "slow devices", having the highest threshold voltage and lowest gain β. In addition to varying the process parameters (to yield slow, typical, or fast devices), the values for resistors 412 and 510 were also varied for the "ss" and "ff" process corners.

For example, waveforms 706 show how $I_3$ varies with temperature for three different values of Vdd (top, center, and bottom curves) for a process that yields "slow" NMOS devices and "fast" PMOS devices. Similarly, waveforms 702 show how $I_3$ varies with temperature for three different values of Vdd for a process that yields "slow" NMOS devices and "slow" PMOS devices, and a minimum resistance value. Waveforms 706, 708, and 710 were obtained through simulations using the nominal resistance value. As seen in waveform curves 702-714, the temperature dependence is very stable across all the process-voltage-temperature (PVT) combinations. The absolute value of the current $I_3$ may vary, and may track mainly the variation in resistance, which is about ±20% for the embodiment illustrated in waveform diagram 700. Most chips may experience smaller resistance variations, as resistance variation may be one of the parameters that a fabrication facility may attempt to control very tightly to reach a target value.

Although the embodiments above have been described in considerable detail, other versions are possible. For example, those skilled in the art will appreciate that while the disclosed embodiments feature certain NMOS/PMOS structures, alternative embodiments are possible in which the NMOS and PMOS devices are interchanged and the circuit structure is correspondingly modified to obtain the same overall functionality that characterizes the embodiments disclosed herein. Similarly, those skilled in the art will also appreciate that specific ones of the transistors in circuits 400 and 500 could be replaced with bipolar devices to obtain the same overall functionality, behavior, and desired benefits that characterize the embodiments disclosed herein. Numerous variations and modifications will become apparent to those skilled in the art once the above disclosure is fully appreciated. It is intended that the following claims be interpreted to embrace all such variations and modifications. Note the section headings used herein are for organizational purposes only and are not meant to limit the description provided herein or the claims attached hereto.

We claim:

1. A current source comprising:

a first resistor;

a first transistor having to first channel terminal coupled in series with the first resistor;

a second transistor coupled to the first transistor and configured to have the magnitude of a first current flowing through the channel of the first transistor determined by a voltage difference (ΔV) divided by the value of the first resistor, wherein ΔV is a difference between a first voltage developed across a control terminal of the first transistor and the first channel terminal of the first transistor, and a second voltage developed across a control terminal of the second transistor and a first channel terminal of the second transistor, wherein the first current has a first temperature coefficient (TC);

a current mirror configured to mirror the first current, to a second channel terminal of the second transistor to obtain a first mirror current having the first TC flowing into the second channel terminal of the second transistor; and a third transistor configured to inject to second current having a second TC different from the first TC into the second channel terminal of the second transistor to obtain a third current flowing through the channel of the second transistor, wherein the magnitude of the third current is a sum of the magnitude of the first mirror current and the magnitude of the second current, and wherein the third current has a third TC that is a combination of the first TC and the second TC.

2. The current source of claim 1, wherein the first TC is positive and the second TC is negative, resulting in the third TC being close to zero.

3. The current source of claim 1, wherein the third transistor has a control terminal coupled to reference ground, a first channel terminal coupled to a supply voltage that provides power to the current source, and a second channel terminal coupled to the second channel terminal of the second transistor, wherein the third transistor is configured to operate in the triode region to obtain the second current at the second channel terminal of the third transistor.

4. The current source of claim 1, wherein a width-to-length ratio (W/L) of the first transistor is considerably larger than the W/L of the second transistor.

5. The current source of claim 1, wherein the third transistor is configured to always conduct current as long as power is supplied to the current source, to eliminate the need of a startup circuit for the current source.

6. The current source of claim 1, wherein the second transistor is diode-connected, the current source further comprising:

a fourth transistor having a control terminal coupled to the control terminal of the second transistor, and a first channel terminal coupled to the first enamel terminal of the second transistor to mirror the third current to a second channel terminal of the fourth transistor to obtain a second mirror current having the third TC.

7. The current source of claim 6, wherein the second channel terminal of the fourth transistor is configured to provide the second mirror current to a load;

wherein the magnitude of the second mirror current is one of:

a multiple of the magnitude of the third current;

the magnitude of the third current; or a fraction of the magnitude of the third current.

8. The current source of claim 1, wherein the current mirror comprises a diode-connected fourth transistor having its channel coupled between a first node and the second channel terminal of the first transistor;

the current source further comprising:

a fifth transistor having a control terminal coupled to the control terminal of the fourth transistor, and a first channel terminal coupled to the first node to mirror the first current to a second channel terminal of the fifth transistor to obtain a second mirror current having the first TC.

9. The current source of claim 8, wherein, the second channel terminal of the fifth transistor is configured to provide the second mirror current to a load;

wherein the magnitude of the second mirror current is one of:

a multiple of the magnitude of the first current;

the magnitude of the first current; or a fraction of the magnitude of the first current.

10. The current source of claim 1, further comprising:

a fourth transistor having a control terminal coupled to a first terminal of the current mirror that is coupled to the second channel terminal of the second transistor, wherein the fourth transistor is configured to conduct a fourth current having the second TC; and a fifth transistor configured to mirror the fourth current to the third transistor to obtain a second mirror current, at the second channel terminal of the third transistor, wherein the second mirror current is the second current.

11. The current source of claim 10, wherein a first channel terminal of the fourth transistor is coupled to the first channel terminal of the second transistor, the current source further comprising:

a second resistor coupled between the first terminal of the current mirror and the second channel terminal of the second transistor to adjust a difference voltage developed between the control terminal of the fourth transistor and the first channel terminal of the fourth transistor to obtain a desired value of the second TC.

12. The current source of claim 11, wherein the fourth transistor is configured to operate in the triode region to obtain the fourth, current.

13. The current source of claim 12;

wherein the first transistor, the second transistor, and the fourth transistor are NMOS devices;

wherein the third transistor and the fifth transistor are PMOS devices; and wherein the comment mirror comprises PMOS devices.

14. The current source of claim 1, wherein the first mirror current has a magnitude that is one of:

a multiple of the magnitude of the first current;

the magnitude of the first current; or a fraction of the magnitude of the first current.

15. A method for generating a stable current, the method comprising:

generating a first current conducted by a first transistor, the first current having:

a first temperature coefficient (TC); and a magnitude determined by a voltage difference (V) divided by the value of a first resistor, wherein $\Delta V$ is a difference between:

a first voltage developed across a control terminal of the first transistor and a first channel terminal of the first transistor; and a second voltage developed across a control terminal of a second transistor and a first channel terminal of the second transistor;

mirroring the first current to a second channel terminal of the second transistor to obtain a first mirror current having the first TC flowing into the second channel terminal of the second transistor;

injecting a second current having a second TC different from the first TC into the second channel terminal of the second transistor to obtain a third current flowing through the channel of the second transistor, the third current having:

a magnitude that is a sum of the magnitude of the first mirror current and the magnitude of the second current; and a third TC that is a combination of the TC of the first current and the TC of the second current.

16. The method of claim 15, wherein said injecting comprises:

operating a third transistor in the triode region; and the third transistor providing the second current in response to said operating.

17. The method of claim 16, further comprising the third transistor always conducting current as long, as sufficient power is supplied to the third transistor.

18. The method of claim 15, further comprising one or more of:

obtaining a first output current having the third TC by mirroring the third current to obtain a second mirrored current as the first output current; or obtaining a second output current having the first TC by mirroring the first current to obtain a third mirrored current as the second output current.

19. The method of claim 18, further comprising one or more of:

subsequent to said obtaining the first output current, applying the first output current to a first load; or subsequent to said obtaining the second output current, applying the second output current to a second load.

20. The method of claim 15, further comprising:

generating a fourth current having the second TC; and mirroring the fourth current to a third transistor to obtain a second mirror current having the second TC; and the third transistor providing the second mirror current as the second current in response to said mirroring the fourth current.

21. The method of claim 20, wherein said generating the fourth current comprises:

operating a fourth transistor in the triode region; and the fourth transistor providing the second entreat in response to said operating.

22. The method of claim 21, wherein the fourth transistor comprises a gate, drain and source, the method further comprising adjusting a gate-source voltage of the fourth transistor to obtain a desired value of the second TC.

23. A current source comprising:

a first branch configured to generate a positive temperature coefficient (PTC) current flowing into a drain of a first transistor and having a magnitude determined by $\Delta V_{gs}/R$, wherein R is the value of a resistance coupled to one end of the channel of a second transistor, and wherein $\Delta V_{gs}$ is a difference between:

a first voltage developed across a gate and source of the second transistor; and a second voltage developed across to gate and source of the first transistor; and a second branch configured to generate a negative temperature coefficient (NTC) current, and further configured to combine the NTC current with the PTC current by injecting the NTC current into the drain of the first transistor to obtain a combination current having a temperature coefficient (TC) that is a combination of a TC of the PTC current and as TC of the NTC current;

wherein the PTC current, the NTC current, and the combination current remain substantially unaffected by variations in a supply voltage used for powering the current source.

24. The current source of claim 23, further comprising a third transistor configured to mirror the combination current to obtain a first mirror current having the TC of the combination currant, and further configured to provide the first mirror current to a load.

25. The current source of claim 23, further comprising a third transistor configured to mirror the PTC current to obtain a first mirror current having the TC of the PTC current, and further configured to provide the first mirror current to a load.

26. A method for generating a stable current, the method comprising:

generating a positive temperature coefficient (PTC) current flowing into a drain of a first transistor, and having a magnitude determined by $\Delta V_{gs}/R$, wherein R is the value of a resistance coupled to one end of the channel of a second transistor, and wherein $\Delta V_{gs}$ is a difference between:

a first voltage developed across a gate and source of the second transistor; and a second voltage developed across a gate and source of the first transistor;

generating as negative temperature coefficient (NTC) current;

injecting the NTC current into the drain of the first transistor to obtain a combination current having a temperature coefficient (TC) that is a combination of a TC of the PTC current and a TC of the NTC current;

wherein said generating the PTC current, said generating the NTC current, and said injecting the NTC current are performed such that the PTC current, the NTC current, and the combination current remain substantially insensitive to variations in a supply voltage used in performing said generating the PTC current, said generating the NTC current, and said injecting the NTC current.

27. The method of claim 26 further comprising one or more of:

mirroring the combination current to obtain a first mirror current having the TC of the combination current, and providing the first mirror current to a first load; or mirroring the PTC current to obtain a second mirror current having the TC of the PTC current, and providing the second minor current to a second load.

* * * * *

UNITED STATES PATENT AND TRADEMARK OFFICE

CERTIFICATE OF CORRECTION

PATENT NO. : 7,944,271 B2
APPLICATION NO. : 12/368378
DATED : May 17, 2011
INVENTOR(S) : Illegems It is certified that error appears in the above-identified patent and that said Letters Patent is hereby corrected as shown below:

In the Claims:

Column 8
Line 38, please delete "having to first channel" and substitute -- having a first channel --;
Line 51, please delete "first current, to a" and substitute -- first current to a --.

Column 9
Line 15, please delete "startup" and substitute -- start-up --;
Line 21, please delete "first enamel terminal" and substitute -- first channel terminal --.

Column 10
Line 7, please delete "the fourth, current" and substitute -- the fourth current --;
Line 25, please delete "(V)" and substitute -- ($\Delta$V) --;
Line 54, please delete "as long, as" and substitute -- as long as --.

Column 12
Line 20, please delete "generating as negative" and substitute -- generating a negative --;
Line 40, please delete "second minor current" and substitute -- second mirror current --.

Signed and Sealed this
Second Day of August, 2011

David J. Kappos

David J. Kappos
*Director of the United States Patent and Trademark Office*